United States Patent [19]

Davitz

[11] 4,097,359

[45] Jun. 27, 1978

[54] WORKPIECE-SUPPORTING RACK

[75] Inventor: Walter E. Davitz, Columbus, Ohio

[73] Assignee: White Castle System, Inc., Columbus, Ohio

[21] Appl. No.: 809,904

[22] Filed: Jun. 24, 1977

[51] Int. Cl.[2] ..... B05C 11/00; C25D 17/08; A47F 5/08; B05C 11/16

[52] U.S. Cl. ..... 204/297 W; 118/500; 118/504; 118/505; 211/116; 211/117; 204/297 R

[58] Field of Search ..... 204/297 R, 297 W, 297 M; 211/116, 117; 118/500, 504, 505, 621

[56] References Cited

U.S. PATENT DOCUMENTS

| | | | |
|---|---|---|---|
| 1,533,805 | 4/1925 | Oliver | 204/297 W |
| 2,793,994 | 5/1957 | Novitsky | 204/297 W |
| 3,272,733 | 9/1966 | Belke | 204/297 W |
| 3,469,710 | 9/1969 | Vosbikian | 211/116 |
| 3,556,977 | 1/1971 | Elbaum | 204/297 W |
| 4,037,727 | 7/1977 | Kunkle | 211/117 |

FOREIGN PATENT DOCUMENTS

| | | | |
|---|---|---|---|
| A76,703 | 10/1961 | France | 204/297 W |

*Primary Examiner*—F.C. Edmundson
*Attorney, Agent, or Firm*—William S. Rambo

[57] ABSTRACT

An electrically conductive rack or frame for transporting and supporting workpieces to be coated, and wherein the workpieces are in electrical contact with and supported on readily removable hooks that are electrically connected to and supported on the frame of the rack. The workpiece-supporting hooks are detachably engaged in struck-out, die-stamped sockets formed in the rack. The rack is also provided with die-stamped locking projections which prevent the hooks from becoming accidentally disengaged from the rack. A removable cover further safeguards the electrical connection between the hooks and the rack and prevents an undesired accumulation of coating material on the interconnecting portions of the hooks and rack.

3 Claims, 5 Drawing Figures

FIG. 1.
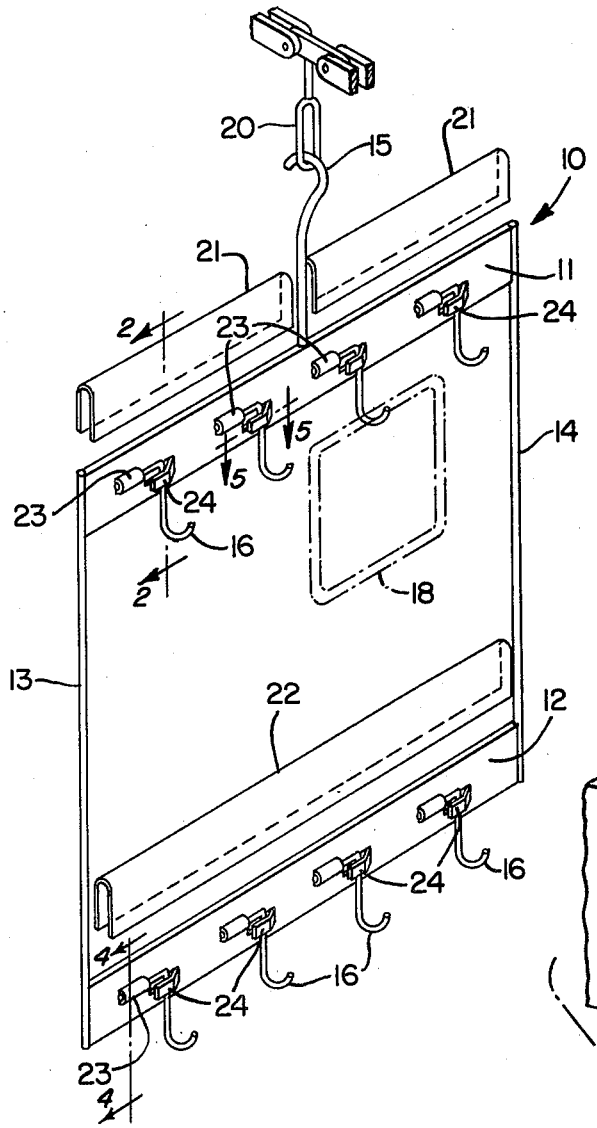
FIG. 2.
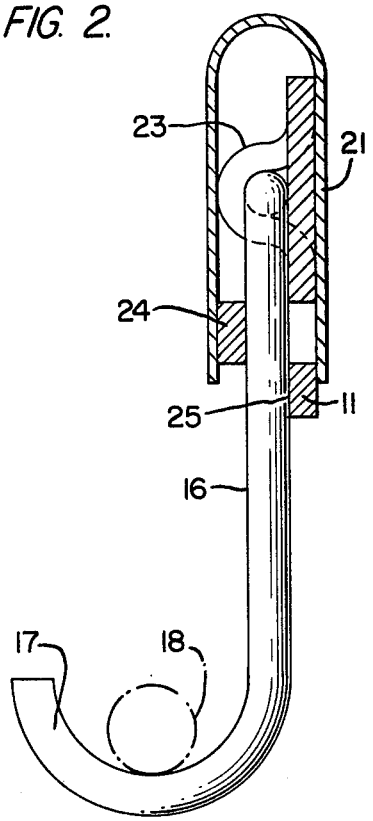
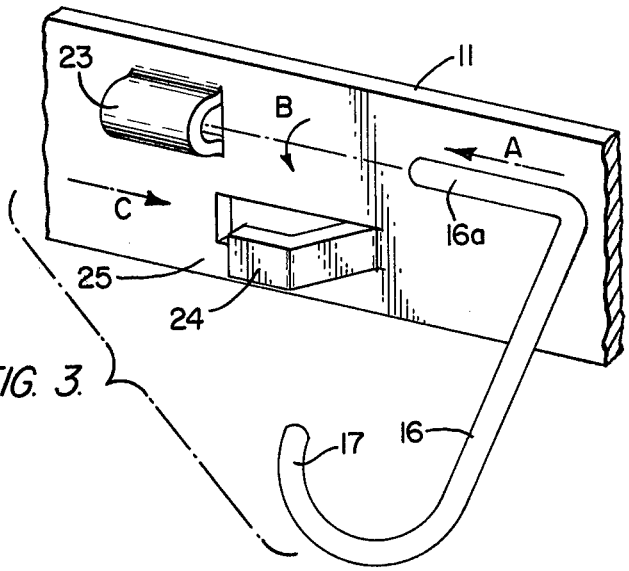
FIG. 3.
FIG. 4.
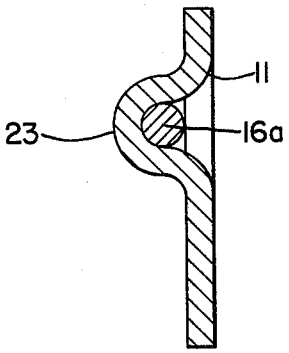
FIG. 5.
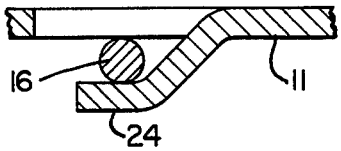

WORKPIECE-SUPPORTING RACK

BACKGROUND OF THE INVENTION

This invention relates generally to racks that are intended for repetitive use in supporting workpieces during electrostatic or similar coating operations.

The closest known prior art is represented by U.S. Pat. No. 2,196,663 issued Apr. 9, 1940 to Isele, 2,258,391 issued Oct. 7, 1941 to Novitsky, 2,729,191 issued Jan. 3, 1956 to Ransburg, 2,730,988 issued Jan. 17, 1956 to Starkey, 2,793,994 issued May 28, 1957 to Novitsky, 2,953,512 issued Sept. 20, 1960 to Villette and 3,469,710 issued Sept. 30, 1969 to Vosbikian.

Racks are frequently used to support a plurality of relatively small parts or workpieces while they are being surface coated and baked. In electrostatic coating operations it is necessary that the racks establish and maintain electrical contact between the workpieces and an overhead carrier or conveyor, in order that the workpieces may be electrically charged, so as to attract the oppositely charged coating material.

Repetitive use of the racks results in a build-up of coating material on the rack with eventual loss of electrical contact between the rack and the workpieces. Eventually, the build-up of coating material must be removed from the racks usually by immersing and soaking the racks in a solvent bath for a prolonged period of time. The need for frequent cleaning demands either prolonged "down" time of the coating apparatus, or a large inventory of racks, both of which add materially to the costs of coating operations.

This invention provides an improved workpiece-supporting rack for use in electrostatic or similar coating operations, wherein the rack may be repetitively used in a comparatively greater number of operations before it requires cleaning or removal of accumulated coating materials therefrom.

The workpiece-supporting rack of this invention comprises a generally open, rectangular border frame made up of metal side members connected at longitudinally spaced intervals by a plurality of metal crosspieces or transverse members which are formed with integral, struck-out socket and clip formations to detachably receive a number of small hooks on which the workpieces may be suspended during coating operations. The rack also includes a plurality of channel form covers which may be frictionally placed on the crosspieces of the frame in positions to cover and shield the interconnecting parts of the sockets and hooks against the deposit of coating materials thereon.

The primary object of this invention is to provide a workpiece-supporting rack for electrostatic coating operations which may be repetitively used over a comparatively longer period of time before requiring cleaning, thereby greatly reducing the number of such racks required to sustain continuous coating operations.

It is a further object of this invention to provide a workpiece-supporting rack which features detachable and interchangeable workpiece-supporting hooks that may be readily removed for cleaning and reuse, wherein the hooks may be removed by a simple sliding, rotating and withdrawal motion in a very short time. The hooks may be re-inserted by a simple reversal of the procedure.

BRIEF DESCRIPTION OF THE DRAWINGS

FIG. 1 is an exploded perspective view of a workpiece-supporting rack according to the present invention, with the protective covers removed from the crosspieces of the racks;

FIG. 2 is an enlarged vertical sectional view taken approximately along the line 2—2 of FIG. 1 and showing the hook and protective cover in place;

FIG. 3 is a fragmentary perspective view showing how a hook is attached to an associated crosspiece;

FIG. 4 is a detailed vertical sectional view taken through one of the hook-receiving sockets formed in a crosspiece; and FIG. 5 is a detailed horizontal sectional view taken approximately along the line 5—5 of FIG. 1.

DESCRIPTION OF PREFERRED EMBODIMENT OF THE INVENTION

Turning now to the drawings, and particularly FIG. 1, the reference numeral 10 designates generally a workpiece-supporting rack constructed of electrically conductive material, such as steel or aluminum. The rack 10 takes the form of an open rectangular border frame which includes an upper transverse member 11, a lower transverse member 12, and side members 13 and 14, and a connector hook 15. The members of rack 10 may be attached to each other by any suitable means, such as by welding, bolting, etc.

Each transverse member 11 and 12 is provided with one or more detachable or removable hook elements 16. These are shown in FIGS. 1 and 2 in their operative in-place and locked positions. The hooks 16 are also made of electrically conductive material. The lower end portion 17 of each hook is bent to receive, support and retain thereon a workpiece 18 to be coated. The workpiece 18, when suspended on the hook 16, is in electrical contact with the metal rack 10, and through the connected hook 15, it is also electrically connected with an overhead conveyor or carrier 20 which is arranged to transport the rack and its supported workpieces through a coating and baking tunnel or the like, not shown.

Each of the transverse members 11 and 12 is formed with integral, lanced and struck-out sockets 23 and locking clips 24 which function to hold and retain hooks 16 in their operative workpiece-supporting positions. Each hook 16 is formed with a laterally directed upper end portion **16*a* which may be inserted axially into a socket 23 in the direction shown by arrow A of FIG. 3. When the end portion 16*a* of the hook is fully inserted in the socket 23, the hook is then pivoted or rotated downwardly in the direction indicated by the arrow B until the shank of the hook is in parallel contact with the outer surface 25 of the transverse member 11 or 12. The hook 16 may be shifted laterally to the right, as indicated by arrow C of FIG. 3, until it is engaged beneath clip 24 where it is locked in place. The hooks 16** may be readily and rapidly disengaged and removed from the rack by reversing the procedure heretofore described.

To prevent a build-up of coating on the upper portions of the hooks 16 and the transverse members 11 and 12 of the rack 10, channel-form covers 21 and 22 are frictionally engaged over the transverse members 11 and 12 when the hooks 16 are in place.

In a typical operation, a selected number of hooks 16 are appropriately engaged in the sockets 23 and locked in clips 24 on the transverse members 11 and 12 of the rack 10. The desired number of workpieces 18 are placed one to each hook 16, so as to fill the rack 10. The workpiece loaded rack 10 is then suspended by its connector hook 15 to the overhead conveyor or carrier 20, and the rack and workpieces are conveyed through an electrostatic coating zone of the processing equipment, and thence through a baking oven to cure the coating on the workpieces. The cured workpieces are then removed from the rack. If the individual hooks have not accumulated too great an amount of coating, they may simply receive additional workpieces for a subsequent repeated operation. However, after a few passes, the hooks will have accumulated so much coating that they must be removed from the rack for cleaning by immersion in a solvent bath. This is easily accomplished by removing the covers 21 and 22, and by disengaging the hooks from the rack and replacing them with clean hooks.

It is an important feature of this invention that the hooks are readily removable for cleaning. This is important in the use of the rack since coating operations cause the hooks to be coated along with the workpiece. Repetitive use of the rack with hooks in place causes a build-up of coating on the hooks which may eventually prevent electrical contact between the workpieces and the hooks.

While a presently preferred embodiment of the invention has been illustrated and described by way of example, it will be understood that various modifications as to details of construction and design may be resorted to without departing from the spirit of the invention or the scope of the following claims.

Having thus described the invention, what is claimed is:

1. A rack supporting workpieces during coating operations comprising:

(a) an essentially open border frame of electrically conductive material including at least one transverse member provided with relatively spaced apart, hookreceiving socket means thereon;

(b) a plurality of electrically conductive, workpiece-supporting hooks detachably and electrically engaged with the socket means of the transverse member of said frame;

(c) removable cover means for covering the engaged portions of said hooks and socket means; and (d) an electrically conductive connector carried by said frame for suspending it from and establishing electrical connection with an overhead carrier.

2. A rack according to claim 1, wherein said socket means comprises a plurality of sockets and clips forming integral parts of the transverse member of said frame.

3. A rack according to claim 1, wherein said workpiece-supporting hooks are readily detachable from said socket means by combined movement of said hooks in both vertical and lateral directions.

* * * * *